US008827262B2

(12) United States Patent
Itabashi et al.

(10) Patent No.: US 8,827,262 B2
(45) Date of Patent: Sep. 9, 2014

(54) SHEET FEEDING APPARATUS AND IMAGE FORMING APPARATUS

(71) Applicant: Canon Kabushiki Kaisha, Tokyo (JP)

(72) Inventors: Toshifumi Itabashi, Toride (JP); Shinsuke Ubayashi, Kashiwa (JP); Hiroshige Inoue, Tokyo (JP); Kozo Inoue, Abiko (JP); Isao Kannari, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/938,503

(22) Filed: Jul. 10, 2013

(65) Prior Publication Data

US 2014/0021678 A1 Jan. 23, 2014

(30) Foreign Application Priority Data

Jul. 19, 2012 (JP) ..... 2012-160255

(51) Int. Cl.
*B65H 1/08* (2006.01)
*B65H 1/18* (2006.01)
*B65H 3/00* (2006.01)

(52) U.S. Cl.
CPC ..... *B65H 3/00* (2013.01)
USPC ..... 271/148; 271/152

(58) Field of Classification Search
CPC ..... B65H 1/00; B65H 1/04; B65H 1/08; B65H 1/14; B65H 1/24; B65H 2405/11162; B65H 2405/11163; B65H 2405/1117; B65H 2405/11172; B65H 2405/1124; B65H 2405/1136
USPC ..... 271/148, 152
See application file for complete search history.

(56) References Cited

U.S. PATENT DOCUMENTS

| | | | | |
|---|---|---|---|---|
| 5,364,087 | A * | 11/1994 | Schieck et al. | 271/148 |
| 5,634,188 | A * | 5/1997 | Johnston et al. | 399/393 |
| 6,283,469 | B1 * | 9/2001 | Weber | 271/148 |
| 7,448,614 | B2 * | 11/2008 | Koga | 271/171 |
| 7,559,547 | B2 * | 7/2009 | Van Dongen et al. | 271/148 |
| 8,348,259 | B2 * | 1/2013 | Marasco et al. | 271/148 |
| 2003/0102623 | A1 * | 6/2003 | Hirai et al. | 271/145 |
| 2006/0284366 | A1 * | 12/2006 | Van Dongen et al. | 271/148 |
| 2007/0228635 | A1 * | 10/2007 | Koga | 271/9.01 |
| 2007/0257419 | A1 * | 11/2007 | Wilcox et al. | 271/148 |
| 2009/0243196 | A1 * | 10/2009 | Kawamoto | 271/147 |

FOREIGN PATENT DOCUMENTS

| | | |
|---|---|---|
| JP | 10-203658 A | 8/1998 |
| JP | 3554127 B2 | 8/2004 |

* cited by examiner

*Primary Examiner* — Kaitlin Joerger
(74) *Attorney, Agent, or Firm* — Cowan, Liebowitz & Latman, P.C.

(57) ABSTRACT

A sheet feeding apparatus and an image forming apparatus which can reliably feed even sheets having a non-uniform thickness to prevent excessive stacking.

An auxiliary tray 1 is swingably provided on the upper surface of a tray 2 which is provided in a cassette body 3*a* to be lifted and lowered and stacks sheets thereon. When the sheets are stacked, a swing regulating portion 12 regulates the swing of the auxiliary tray 1 when the tray 2 is in a sheet stacking position and releases the regulation of the swing of the auxiliary tray 1 when the tray 2 is lifted.

15 Claims, 10 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus. More specifically, the present invention relates to a configuration for feeding sheets, such as envelopes, having a non-uniform thickness.

2. Description of the Related Art

At present, an image forming apparatus, such as a copying machine, printer, and facsimile, in which an image forming portion forms an image on a sheet fed from a sheet feeding apparatus, has been widely used. In the sheet feeding apparatus, typically, a sheet feeding cassette which accommodates sheets therein is detachably attached to an apparatus body so that a pickup roller provided in the apparatus body automatically feeds the sheets accommodated in the sheet feeding cassette.

In order for the pickup roller to press and feed the sheets stacked on the tray of the sheet feeding cassette, the sheet feeding apparatus has a lifting and lowering portion which can lift and lower the tray which stacks the sheets thereon. Further, to accommodate different-sized sheets, the sheet feeding cassette has a slidable trailing end regulating portion which regulates the position of an upstream end in a sheet feeding direction of the sheets stacked on the tray (hereinafter, a trailing end). The sheet feeding cassette also has a pair of side end regulating portions which regulate side end positions in a direction perpendicular to the sheet feeding direction of the sheets stacked on the tray (hereinafter, a width direction).

The pair of side end regulating portions regulates the side ends of each sheet on the tray, and the trailing end regulating portion regulates the trailing end of each sheet on the tray, thereby positioning the position of each sheet into a predetermined position. Each sheet is thus positioned on the tray of the sheet feeding cassette. The tray is then lifted by the lifting and lowering portion to press the pickup roller onto the stacked sheets, so that the pickup roller is rotated to feed the sheets.

Conventionally, to continuously feed envelopes in the sheet feeding apparatus, an envelope-specific unit is attached to the sheet feeding cassette to continuously feed the envelopes accommodated in the envelope-specific unit by the pickup roller. The envelope-specific unit urges an auxiliary tray which stacks the envelopes thereon upward by a spring to press the envelopes on the auxiliary tray onto the pickup roller by the resilient force of the spring (see Japanese Patent Laid-Open No. 10-203658). The pickup roller is then rotated to feed the envelopes.

Although, conventionally, the envelopes are fed using the envelope-specific unit, it is considered, from a request to simplify the envelope feeding configuration, that the envelopes are fed using the lifting and lowering portion of the tray of the sheet feeding cassette without using the spring.

However, as illustrated in FIG. 9A, envelope PA has a flap 14 which closes its inlet. The flap 14 covers part of envelope PA, not the entire surface of envelope PA, so that the portion of envelope PA which is covered by the flap 14 is thicker than the portion of envelope PA which is not covered by the flap 14. That is, the sheet is folded on its front and back sides to be formed in a bag shape, thereby folding the flap 14 on its end, so that envelope PA has the portion having a thickness of two sheets and the portion having a thickness of three sheets.

Therefore, when envelopes PA are stacked in the same direction, as illustrated in FIG. 9B, the bundle of envelopes is thick on the flaps 14 side to have a non-uniform thickness. Suppose that the tray of the sheet feeding cassette is lifted to press the bundle of stacked envelopes onto the pickup roller. As illustrated in FIG. 10, a pickup roller 104 is pressed onto one side in the width direction of the upper surface of the bundle of envelopes PA, so that the feeding pressure becomes non-uniform. As a result, sheet feeding failure due to insufficient feeding pressure and conveying failure such as sheet skew feeding and jamming are caused.

Accordingly, the present invention has been made in view of the circumstances, and it is desirable to provide a sheet feeding apparatus and an image forming apparatus which can reliably feed even sheets, such as envelopes, having a non-uniform thickness.

SUMMARY OF THE INVENTION

The present invention provides a sheet feeding apparatus including a sheet accommodating portion which has a sheet accommodating portion body which accommodates sheets therein and a sheet stacking portion which is provided in the sheet accommodating portion body to be lifted and lowered and stacks the sheets thereon, a sheet feeding portion which is provided above the sheet accommodating portion and feeds the sheets stacked on the sheet stacking portion, a lifting and lowering portion which lifts the sheet stacking portion to press the sheets stacked on the sheet stacking portion onto the sheet feeding portion, a swingable stacking portion which is swingably provided on the upper surface of the sheet stacking portion and stacks the sheets thereon, and a swing regulating portion which regulates the swing of the swingable stacking portion when the sheet stacking portion is in a sheet stacking position and releases the regulation of the swing of the swingable stacking portion when the sheet stacking portion is lifted.

According to the present invention, the swing of the swingable stacking portion is regulated when the sheet stacking portion is in the sheet stacking position, and the regulation of the swing is released when the sheet stacking portion is lifted, so that even the sheets having a non-uniform thickness can be reliably fed to prevent excessive stacking.

Further features of the present invention will become apparent from the following description of exemplary embodiments with reference to the attached drawings.

DESCRIPTION OF THE EMBODIMENTS

Figure 1:
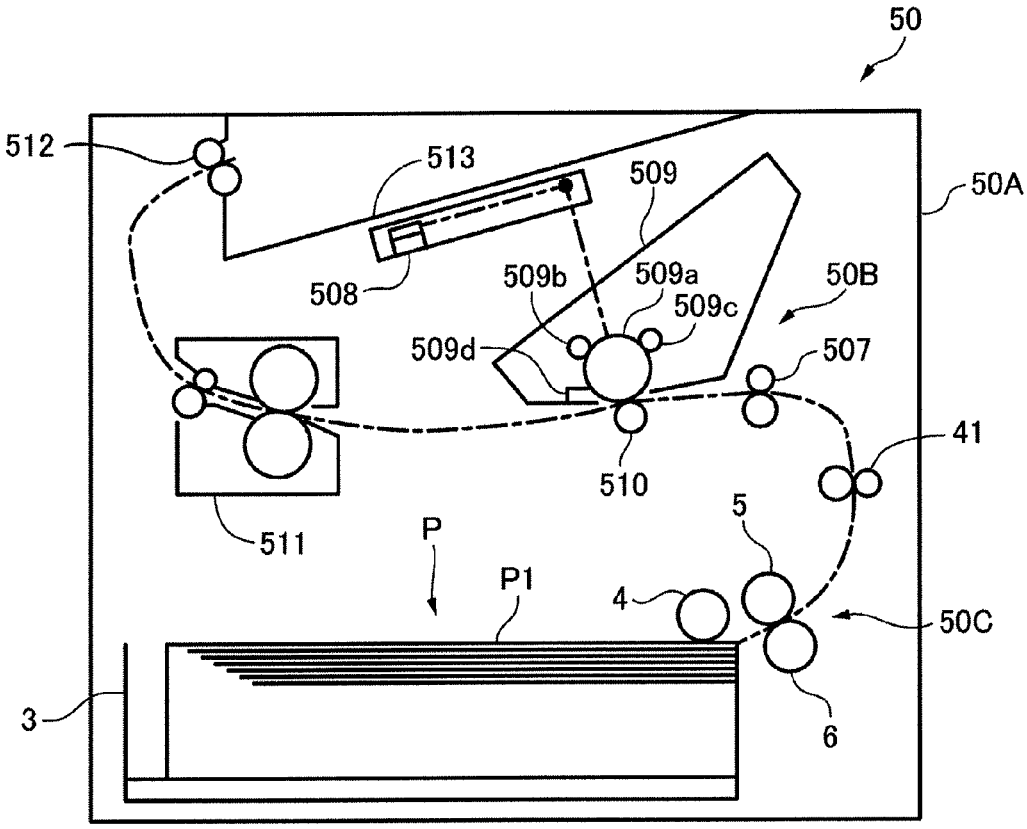
FIG. 1 is a diagram illustrating an overall configuration of a laser beam printer (LBP) of an example of an image forming apparatus including a sheet feeding apparatus according to a first embodiment of the present invention.

Embodiments of the present invention will be described below in detail with reference to the drawings. FIG. 1 is a diagram illustrating an overall configuration of a laser beam printer (LBP) of an example of an image forming apparatus including a sheet feeding apparatus according to a first embodiment of the present invention.

FIG. 1 illustrates a laser beam printer 50, and a laser beam printer body (hereinafter, printer body) 50A. The printer body 50A includes an image forming portion 50B. The printer body 50A is provided in its lower portion with a sheet feeding apparatus 50C which feeds sheets P, such as recording sheets, stacked and accommodated in a sheet feeding cassette 3, to the image forming portion 50B.

Here, the image forming portion 50B includes a process cartridge 509 which includes a photosensitive drum 509*a*, a charger 509*b*, a developing sleeve 509*c*, and a cleaner 509*d*. The printer body 50A includes a laser scanner 508 which is an exposing unit which exposes the surface of the photosensitive drum 509*a* to form an electrostatic latent image on the photosensitive drum 509*a*. The printer body 50A includes a transfer roller 510 which is abutted onto the photosensitive drum 509*a* and configures a transferring portion together with the photosensitive drum 509*a*, and a fixing portion 511 which fixes a toner image transferred by the transferring portion onto each sheet P.

The sheet feeding apparatus 50C includes a pickup roller 4 as a sheet feeding portion which feeds the uppermost one of sheets P stacked in the sheet feeding cassette 3 as a sheet accommodating portion. The sheet feeding apparatus 50C also includes a feed roller 5 as a sheet conveying roller which is rotated in a sheet conveying direction, and a retard roller 6 as a separating roller which forms a separation nip portion which is pressed onto the feed roller 5 and separates each sheet between the retard roller 6 and the feed roller 5.

The retard roller 6 configures a sheet conveying portion provided on the downstream side in a sheet feeding direction of the pickup roller 4 together with the feed roller 5. The retard roller 6 is provided to be rotatable in the opposite direction of the sheet conveying direction, and can be rotated (driven) along with the feed roller 5. The feed roller 5 and the retard roller 6 configure a pair of separating rollers 5 and 6 of a retard separation type which separates and conveys each sheet P fed by the pickup roller 4.

Next, the image forming operation of the laser beam printer 50 will be described. When the image forming operation is started, the photosensitive drum 509*a* is rotated clockwise so that its surface is charged by the charger 509*b*. The laser scanner 508 then emits a laser light onto the photosensitive drum 509*a* based on image information. With this, the electrostatic latent image is formed on the photosensitive drum. Toner which has been subjected to moderate charging with the rotation of the developing sleeve 509*c* is supplied onto the photosensitive drum 509*a* to adhere onto the electrostatic latent image. The electrostatic latent image is developed to be visible as the toner image.

On the other hand, the pickup roller 4 of the sheet feeding apparatus 50C is rotated along with the toner image forming operation to feed uppermost sheet P1 in the sheet feeding cassette 3. Sheet P1 which has been fed by the pickup roller 4 is separated and conveyed by the pair of separating rollers 5 and 6, is conveyed to a pair of registration rollers 507 being stopped by a conveying roller 41, and is subjected to leading end registration (skew feeding correction).

Sheet P1 is conveyed to the transferring portion by the pair of registration rollers 507 at the timing of forming the image on the photosensitive drum 509*a* in the image forming portion 50B. The image of the photosensitive drum 509*a* is transferred onto sheet P1 by the transfer roller 510. Sheet P1 onto which the toner image has been transferred is conveyed to the fixing portion 511. The unfixed toner image is heated and pressurized to be fixed onto the surface of the sheet. Sheet P1 onto which the toner image has been fixed is discharged onto a discharge tray 513 by a discharge roller 512.

Figure 2A:
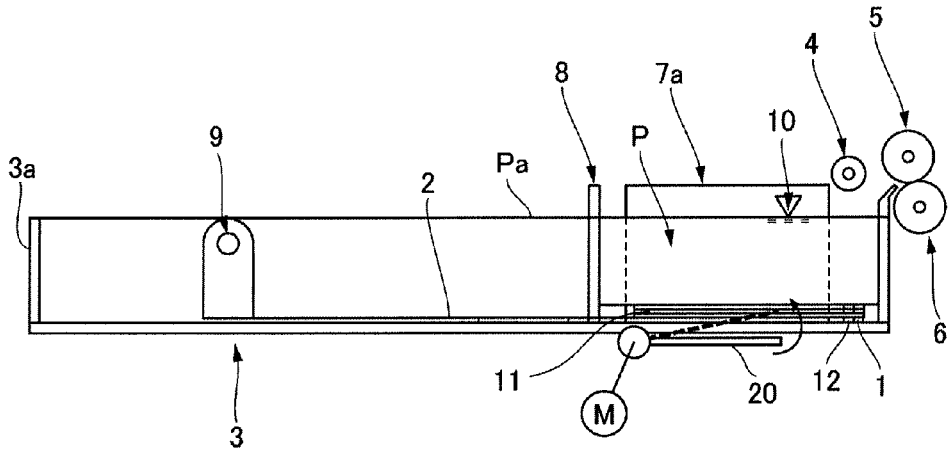
FIGS. 2A and 2B are diagrams describing a configuration of the sheet feeding apparatus.
Figure 2B:
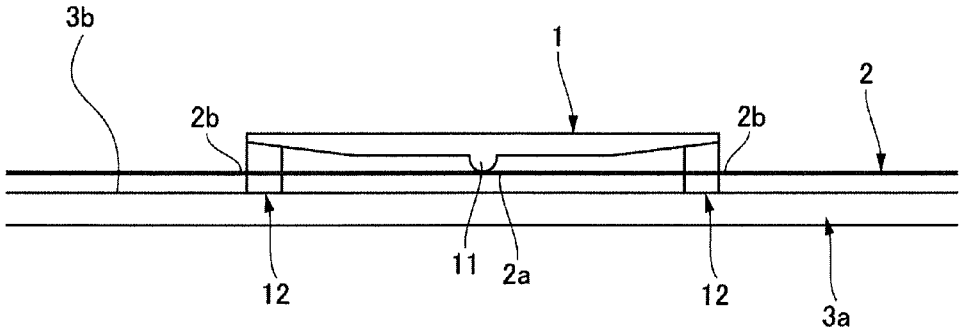
Figure 3A:
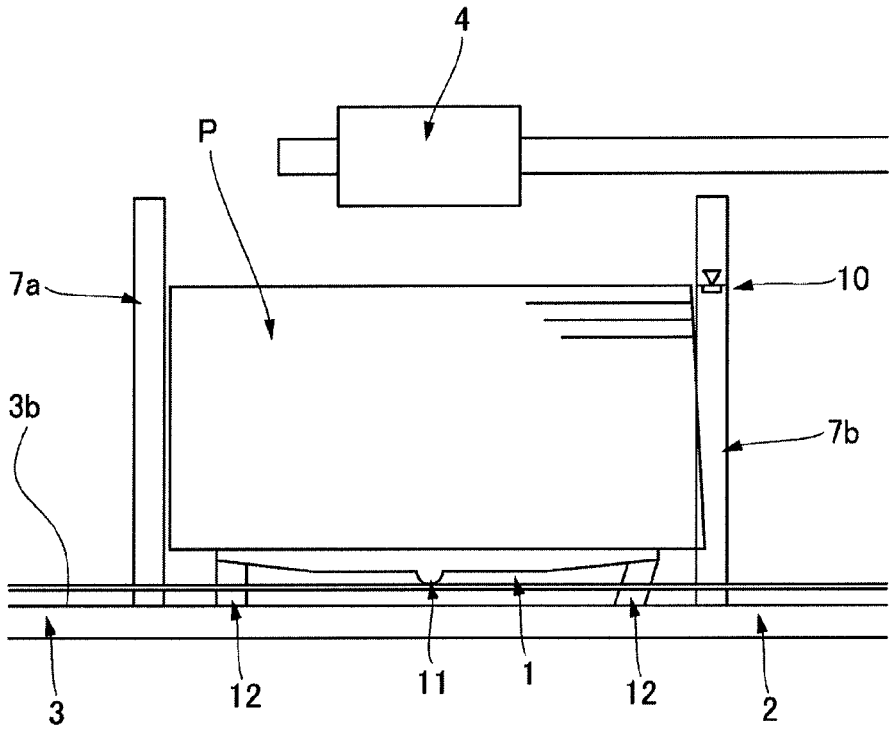
FIGS. 3A and 3B are diagrams describing the sheet stacking state of the sheet feeding apparatus.
Figure 3B:
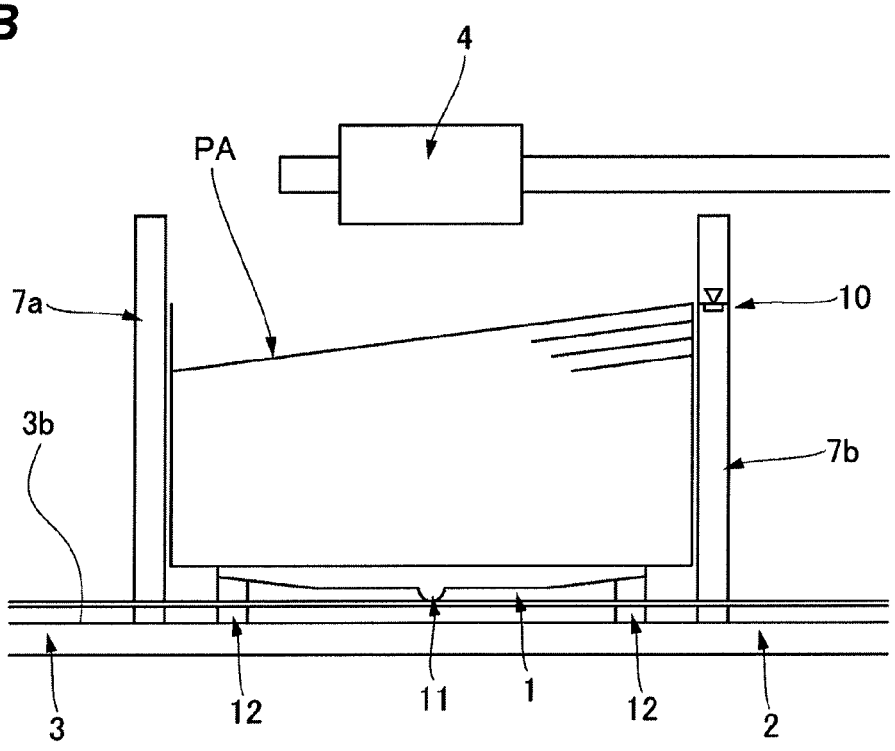

FIGS. 2A and 2B are diagrams describing a configuration of the sheet feeding apparatus 50C. In FIG. 2A, a tray 2 is a sheet stacking portion which is provided in a cassette body 3*a* as a sheet accommodating portion body of the sheet feeding cassette 3, can be lifted and lowered, and supports the sheets. The tray 2 is turned up and down at a turning support point 9 provided in the cassette body 3*a*. A side regulating plate 7*a* is a sheet side end regulating portion which regulates the position of one end in a width direction perpendicular to the sheet feeding direction of the sheets accommodated in the sheet feeding cassette 3. The other end in the width direction of the sheets is regulated by a side regulating plate 7*b* which is illustrated in FIGS. 3A and 3B described later and is opposite the side regulating plate 7*a*. That is, both side ends of the sheets stacked on the tray 2 are regulated by the pair of side regulating plates 7*a* and 7*b*. The center in the width direction of the sheets regulated by the side regulating plates 7*a* and 7*b* coincides with the center in an axial direction of the pickup roller 4.

A trailing end regulating plate 8 regulates the position of an upstream end in the sheet feeding direction (trailing end) of the sheets accommodated in the sheet feeding cassette 3. A lifter member 20 is provided below the tray 2, and is driven by a driving portion (motor M) to be turnable upward. The lifter member 20 is turned to turn (lift) the tray 2 upward. That is, the lifter member 20 lifts the tray 2 from a sheet stacking position as a lowered position for supplying the sheets into a position in which the sheets can be fed by the pickup roller 4, and abuts the pickup roller 4 onto the upper surface of the bundle of sheets on the tray 2. In this embodiment, the lifter member 20 and the driving portion, not illustrated, configure a lifting and lowering portion which lifts the tray 2 so as to press the pickup roller 4 onto the stacked sheets.

An auxiliary tray 1 as a swingable stacking portion is detachably provided between the side regulating plates 7*a* and 7*b* and the trailing end regulating plate 8 on the upper surface of the tray 2. The auxiliary tray 1 is swingably supported on the upper surface of the tray 2 by a later-described configuration. When the auxiliary tray 1 is attached, it is swung so as to allow the upper surface of the uppermost sheet to follow the pickup roller 4 when the tray 2 is lifted from the sheet stacking position into the position in which the sheets can be fed by the pickup roller 4 so that the upper surface of the uppermost sheet is abutted onto the pickup roller 4. The auxiliary tray 1 is swung to allow the upper surface of the uppermost sheet to follow the pickup roller 4, so that the pickup roller 4 can be abutted onto the upper surface of the uppermost sheet at a substantially uniform pressure (feeding pressure) in the width direction.

Here, as illustrated in FIG. 2B, a projected swing support point 11 is extended from a downstream end along the upstream end in the sheet feeding direction (in the right-left direction of FIG. 2A) at the center in the width direction of the bottom surface of the auxiliary tray 1. The swing support point 11 is located directly below the center in the width direction of the pickup roller 4 (the alternate long and short dash line of FIGS. 3A and 3B). Swing regulating portions 12 are provided on both ends in the width direction of the bottom surface of the auxiliary tray 1. The swing regulating portions 12 regulate the swing of the auxiliary tray 1 when the tray 2 is in the sheet stacking position as the lowered position for supplying the sheets.

Figure 9A:
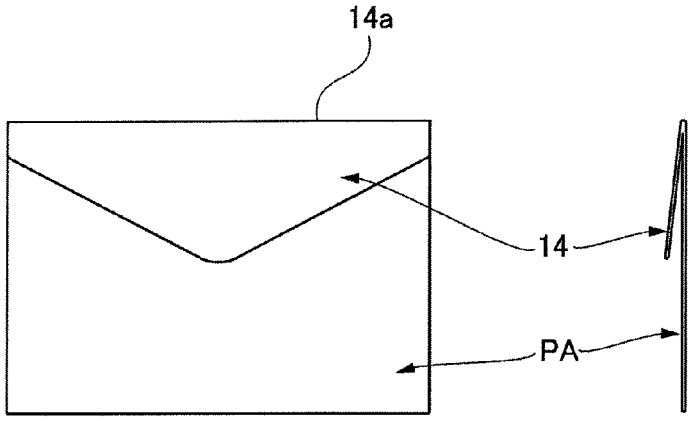
FIG. 9A PRIOR ART
FIGS. 9A and 9B are diagrams describing the envelope stacking state of a conventional sheet feeding apparatus.

At the center in the width direction of the upper surface of the tray 2, a recess 2*a* which positions the swing support point 11 of the auxiliary tray 1 is formed. On both ends in the width direction of the tray 2, insertion holes 2*b* through which the swing regulating portions 12 of the auxiliary tray 1 are inserted are formed. In this embodiment, envelopes PA as the sheets, as illustrated in FIG. 9A, can be fed, and envelopes PA are set in the same direction so that folded portions 14*a* of the flaps 14 of envelopes PA are regulated by the side regulating plate 7*b*. That is, envelopes PA are set so that an extending direction of the projected swing support point 11 of the auxiliary tray 1 is parallel to the folded portions 14*a* of the flaps 14 of envelopes PA.

FIG. 2B illustrates a state before the sheets are accommodated in the sheet feeding cassette 3. At this time, the tray 2 is lowered to the sheet stacking position, so that the swing regulating portions 12 of the auxiliary tray 1 are projected downward from the insertion holes 2*b* of the tray 2 to be abutted onto a bottom 3*b* of the cassette body 3*a*. In a state where the auxiliary tray 1 is regulated by the swing regulating portions 12, the upper surface of the auxiliary tray 1 is parallel to the upper surface of the tray 2. When the cut sheets having a uniform thickness are accommodated in the sheet feeding cassette 3 in a state where the auxiliary tray 1 is attached, as illustrated in FIG. 3A, the swing of the auxiliary tray 1 is regulated so that the upper surface of the bundle of sheets P becomes horizontal. Thereafter, when the tray 2 is turned upward to feed sheets P, the regulation of the auxiliary tray 1 by the swing regulating portions 12 is released so that the auxiliary tray 1 is swingable at the swing support point 11, but the upper surface of the bundle of sheets P is abutted onto and follows the pickup roller 4. For feeding the cut sheets having a uniform thickness, the auxiliary tray 1 may be detached from the sheet feeding cassette 3 to place the cut sheets on the tray 2.

Figure 9B:
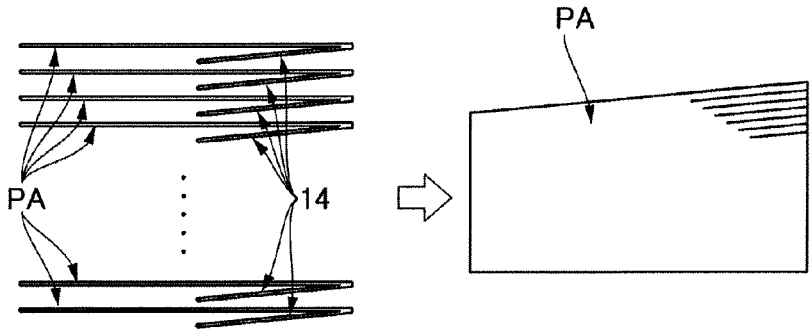
FIG. 9B PRIOR ART
Figure 10:
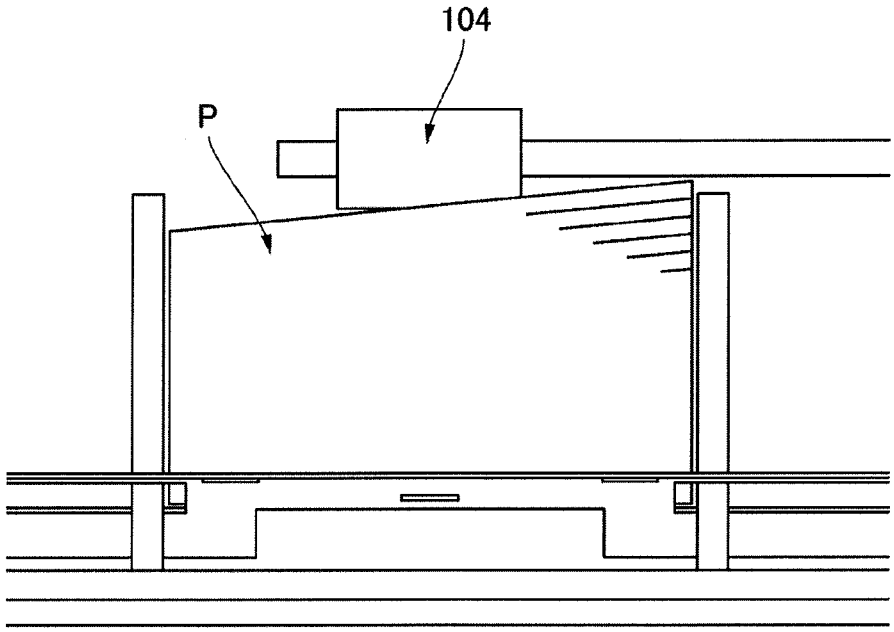
FIG. 10 PRIOR ART
FIG. 10 is a diagram describing the envelope feeding state of the conventional sheet feeding apparatus.

On the other hand, when the bundle of envelopes PA which is thick on the flaps 14 side, as illustrated in FIG. 9B, is accommodated in the sheet feeding cassette 3, the bundle of envelopes PA is tilted, as illustrated in FIG. 3B, since the swing regulating portions 12 are abutted onto the bottom 3*b* of the cassette body 3*a* to regulate the swing of the auxiliary tray 1. However, even when the bundle of envelopes PA is tilted, the tray 2 is lifted from the sheet stacking position to feed envelopes PA to lift the auxiliary tray 1. With this, the abutment of the swing regulating portions 12 onto the bottom 3*b* of the cassette body 3*a* is released. That is, when the tray 2 is lifted from the sheet stacking position by the lifting and lowering portion, the regulation of the swing of the auxiliary tray 1 is released so that the auxiliary tray 1 is swingable at the swing support point 11.

Figure 4A:
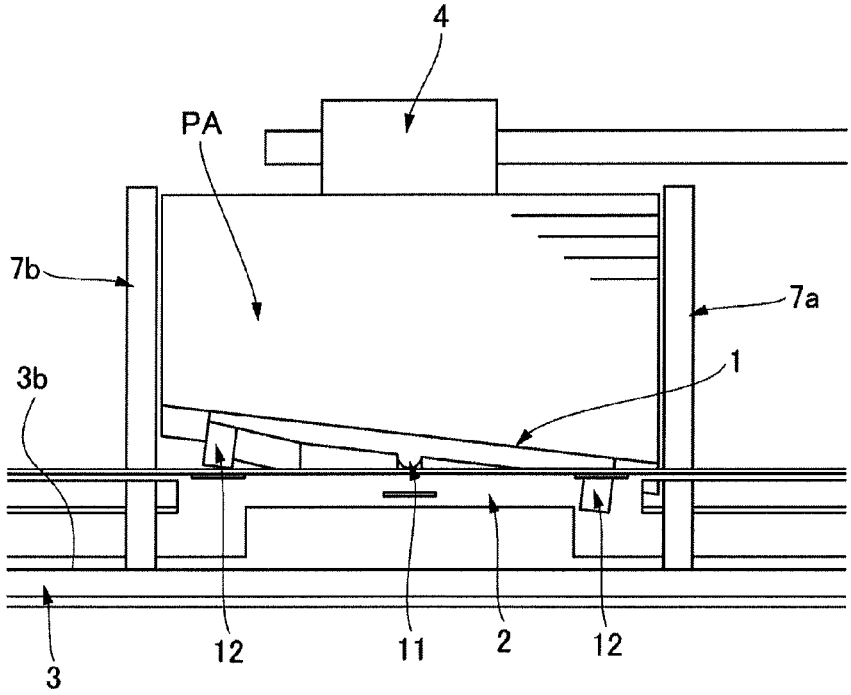
FIGS. 4A and 4B are diagrams describing the sheet feeding state of the sheet feeding apparatus.

When the tray 2 is further lifted in a state where the regulation of the swing of the auxiliary tray 1 is released, the auxiliary tray 1 is tilted to the flaps 14 side at the swing support point 11, as illustrated in FIG. 4A, since the bundle of envelopes PA on the flaps 14 side is heavy.

Thereafter, the tray 2 is lifted to press the pickup roller 4 onto the bundle of envelopes PA, the upper surface of the bundle of envelopes PA follows the pickup roller 4, so that the feeding pressure is uniformly applied onto the bundle of envelopes PA by the pickup roller 4. As a result, feeding failure of envelopes PA due to insufficient feeding pressure and conveying failure such as skew feeding and jamming can be prevented from being caused.

In this embodiment, the swing of the auxiliary tray 1 is regulated by the swing regulating portions 12 when the tray 2 is in the sheet stacking position. When there is not the swing regulating portions 12, the auxiliary tray 1 is tilted at the time of setting the bundle of envelopes PA to tilt the set envelope bundle.

Figure 8A:
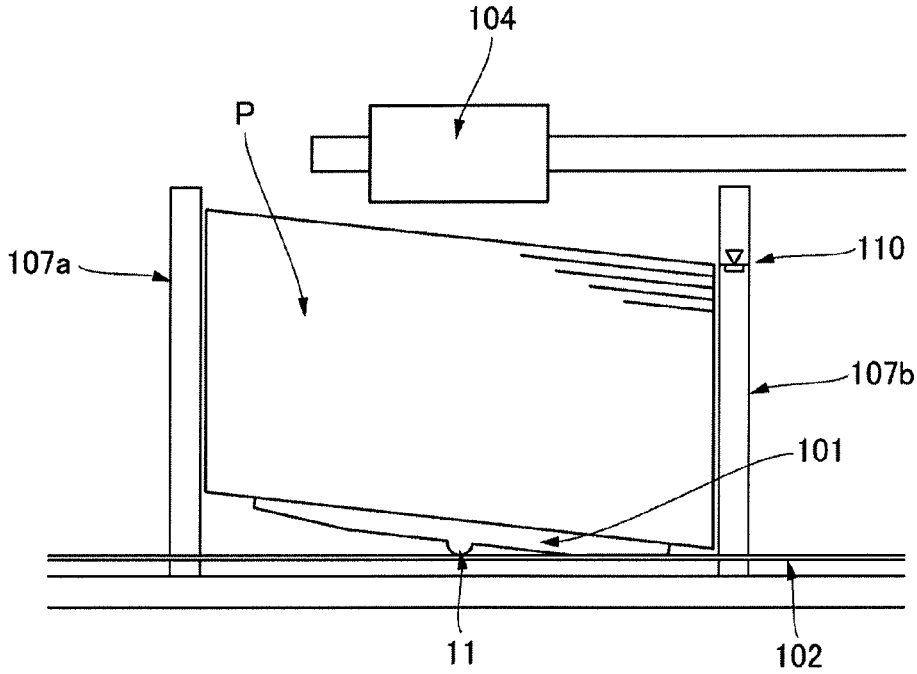
FIGS. 8A and 8B are diagrams describing a sheet accommodating state on an auxiliary tray which is swingably provided on a tray of the sheet feeding apparatus.
Figure 8B:
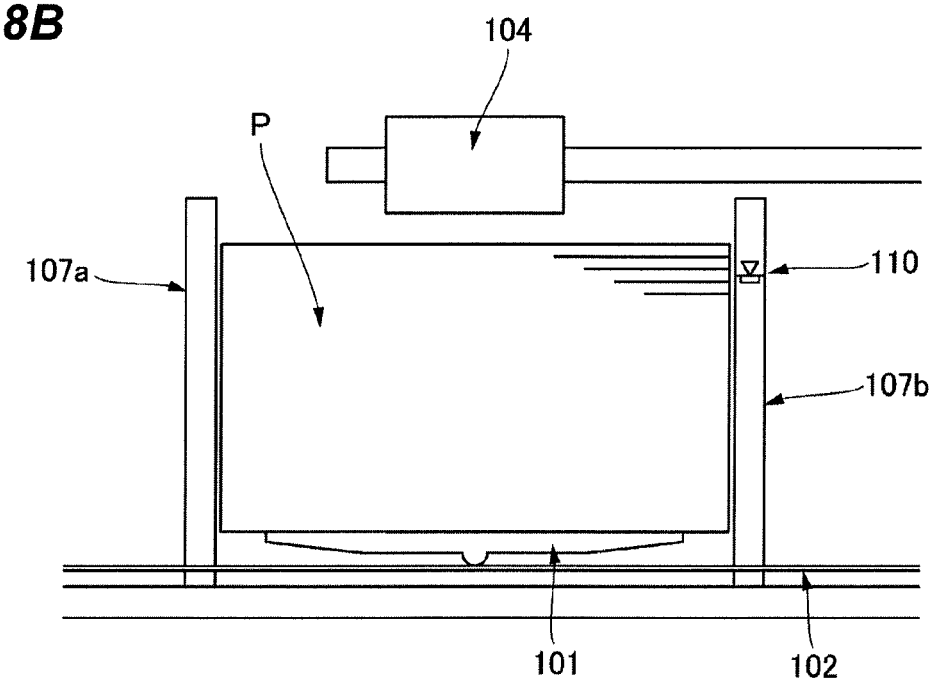

Here, as illustrated in FIGS. 8A and 8B, of a pair of side end regulating portions 107*a* and 107*b*, the side end regulating portion 107*b* on the rear side is provided with a sheet stack upper limit displaying portion 110. In this case, as illustrated in FIG. 8A, when sheets P are set according to the sheet stack upper limit displaying portion 110, the following problem arises. When a tray 102 on which the bundle of envelopes PA is stacked is lifted to press a pickup roller 104 onto the bundle of envelopes PA, an auxiliary tray 101 is not tilted. At this time, as illustrated in FIG. 8B, the upper surface position of the bundle of envelopes PA exceeds the sheet stack upper limit displaying portion 110.

That is, when the swingable auxiliary tray 101 is provided on the tray 102, the upper surface of the bundle of envelopes PA exceeds the sheet stack upper limit displaying portion 110 to cause excessive stacking. The excessive stacking of the bundle of envelopes PA can cause feeding failure. A displayed position needs to be set to be low in order not to cause excessive stacking even when the bundle of envelopes PA exceeds the sheet stack upper limit displaying portion 110. When the displayed position is set to be low, the space in the apparatus is wasted (the maximum number of sheets stacked is reduced).

On the contrary, the swing regulating portions 12 are provided on the auxiliary tray 1, the bundle of sheets P is not tilted when it is accommodated, so that the bundle of sheets can be set at a proper height according to a sheet stack upper limit displaying portion 10 of the side regulating plate 7. Excessive stacking can thus be prevented. That is, as illustrated in FIG. 3B, the upper surface of the bundle of envelopes PA coincides with the sheet stack upper limit displaying portion 10. Thus, the excessive stacking of the bundle of envelopes PA cannot be caused.

In this embodiment, when the tray 2 is turned upward, the regulation of the swing of the auxiliary tray 1 by the swing regulating portions 12 is released. With this, when the upper surface of the bundle of envelopes having a non-uniform thickness is abutted onto the pickup roller 4, the auxiliary tray 1 is swung to allow the upper surface of the bundle of envelopes to follow the pickup roller 4. As a result, the pickup roller 4 is uniformly abutted onto the upper surface of the bundle of envelopes so that the feeding pressure at feeding can be stable. Thus, feeding failure due to non-uniform feeding pressure can be prevented from being caused.

That is, in this embodiment, the swing of the auxiliary tray 1 is regulated when the tray 2 is in the sheet stacking position, and the regulation of the swing is released when the tray 2 is turned upward. Even the sheets, such as the envelopes, having a non-uniform thickness, can thus be reliably fed to prevent excessive stacking.

Figure 5A:
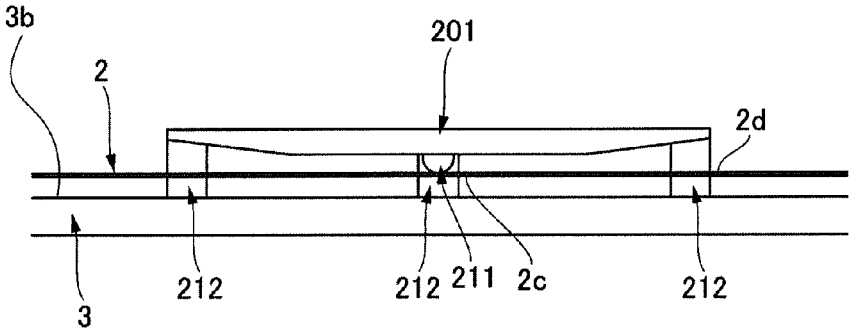
FIGS. 5A, 5B, and 5C are diagrams describing another configuration of the sheet feeding apparatus.
Figure 5B:
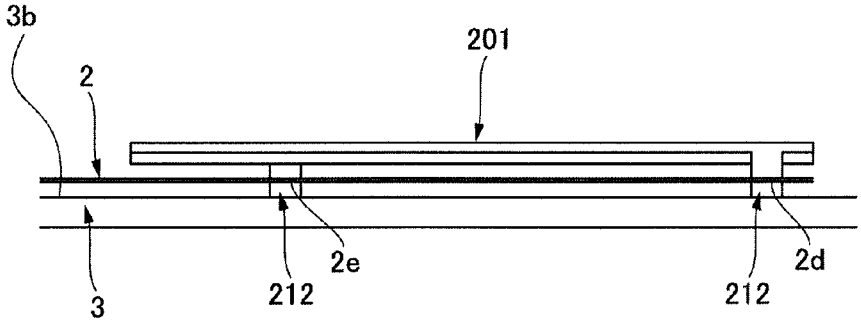
Figure 5C:
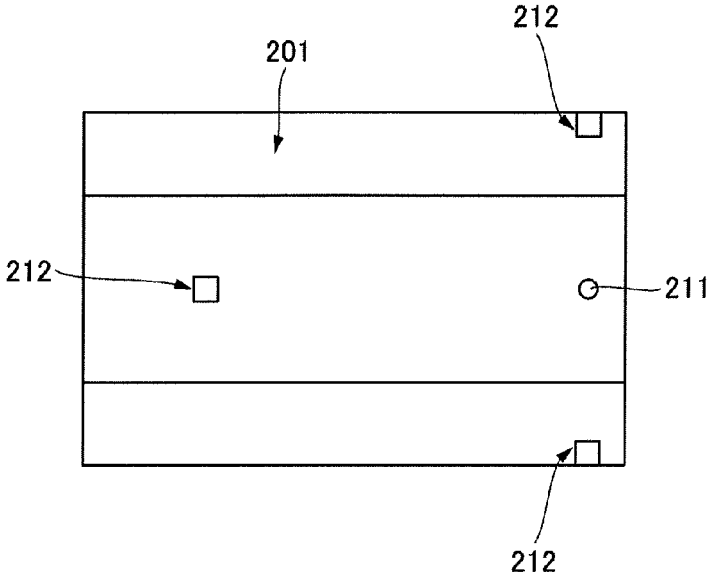

The configuration in which both side ends in the width direction of the auxiliary tray 1 are swung up and down at the projection which is extended in the sheet feeding direction at the center in the width direction thereof, as the support point, has been described above. However, the upstream end and the downstream end in the sheet feeding direction of the auxiliary tray 1 may be swung up and down at the projection which is extended in the width direction thereof, as the support point. That is, the auxiliary tray 1 may be swung at the projection which is extended in at least one of the sheet feeding direction and the width direction. In addition, the auxiliary tray 1 is not limited to have one free degree, but may have two free degrees. FIGS. 5A, 5B, and 5C are diagrams describing a configuration of the auxiliary tray having two free degrees. As illustrated in FIGS. 5A to 5C, an auxiliary tray 201 has swing regulating portions 212 on both ends in the width direction and on the upstream side in the sheet feeding direction.

As illustrated in FIGS. 5A and 5B, a semispherical swing support point 211 of the auxiliary tray 201 is provided so that the auxiliary tray 201 can be swung at two free degrees (two free dimensions). A recess 2*c* which positions the auxiliary tray 201 is formed at the center in the width direction on the upper surface of the tray 2. The semispherical swing support point 211 is positioned at the recess 2*c* of the auxiliary tray 201, so that the auxiliary tray 201 can be swung in a different direction in a fixed position. Insertion holes 2*d* through which the swing regulating portions 212 of the auxiliary tray 201 are inserted are formed on both ends in the width direction of the tray 2. Further, an insertion hole 2*e* through which the swing regulating portion 212 of the auxiliary tray 201 is inserted is formed on the upstream side in the sheet feeding direction of the tray 2.

In the above description, the swing regulating portions 12 and 212 are provided on both ends in the width direction of the auxiliary trays 1 and 201, respectively. However, the present invention is not limited to this, and the swing regulating portion may be provided on one side of the auxiliary tray.

Figure 6A:
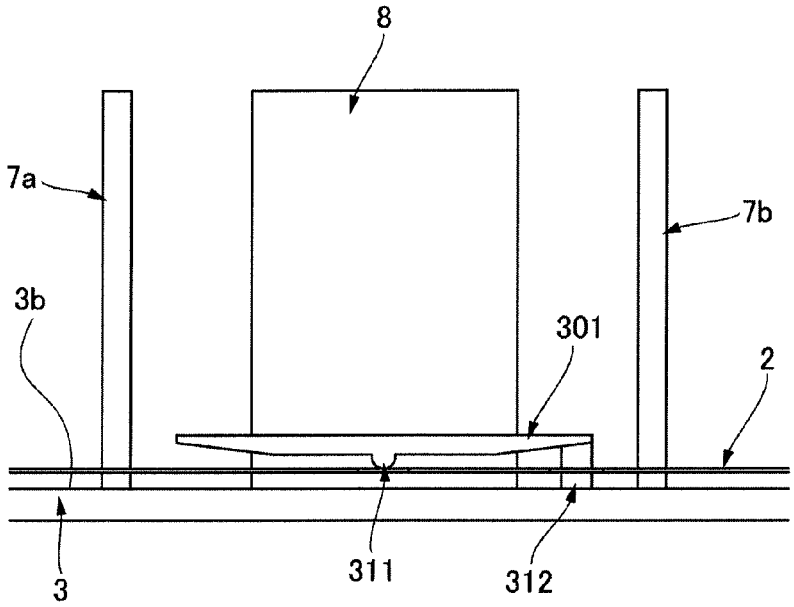
FIGS. 6A and 6B are diagrams describing a configuration of the sheet feeding apparatus according to a second embodiment of the present invention.
Figure 6B:
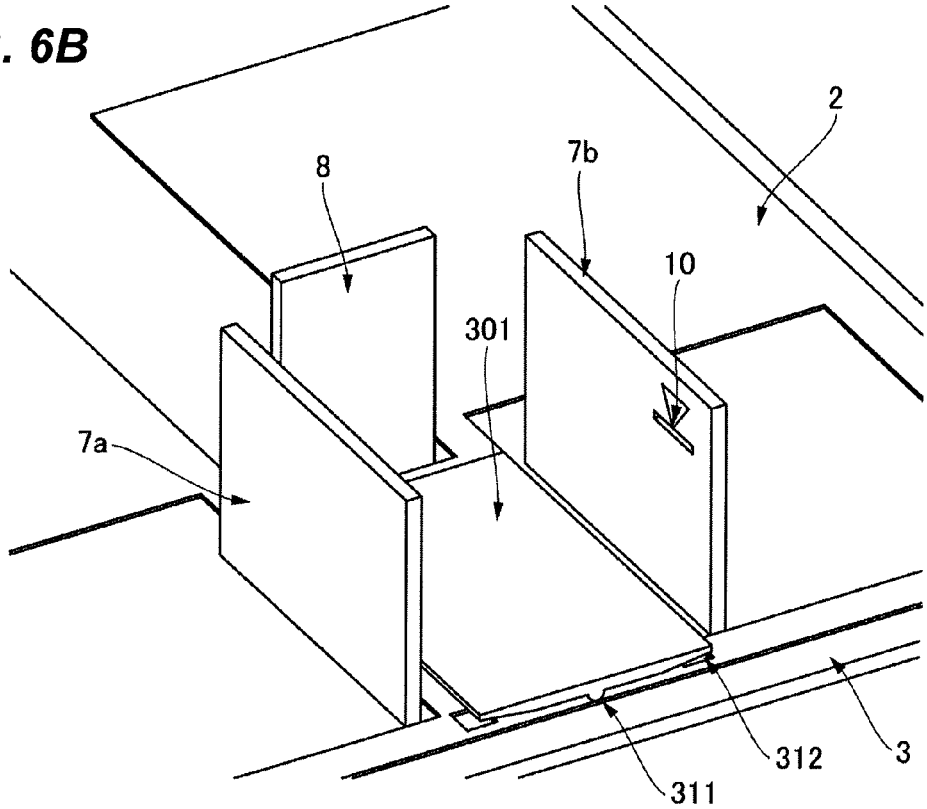

A second embodiment of the present invention in which the swing regulating portion is provided on one side of the auxiliary tray will be described. FIGS. 6A and 6B are diagrams illustrating a configuration of the sheet feeding apparatus according to this embodiment. In FIGS. 6A and 6B, the same reference numerals as FIGS. 2A and 2B indicate similar or corresponding portions.

In FIGS. 6A and 6B, an auxiliary tray 301 is illustrated. A swing regulating portion 312 of the auxiliary tray 301 is provided only on, of the pair of side regulating plates 7*a* and 7*b*, the side regulating plate 7*b* (sheet side end regulating portion side) which is formed with the sheet stack upper limit displaying portion 10 which displays a sheet stack upper limit position on the inner wall surface thereof abutted onto the sheets. That is, at least one swing regulating portion 312 is provided only on the side regulating plate 7*b* on the rear side in which there is the sheet stack upper limit displaying portion 10 with respect to a swing support point 311.

Figure 7A:
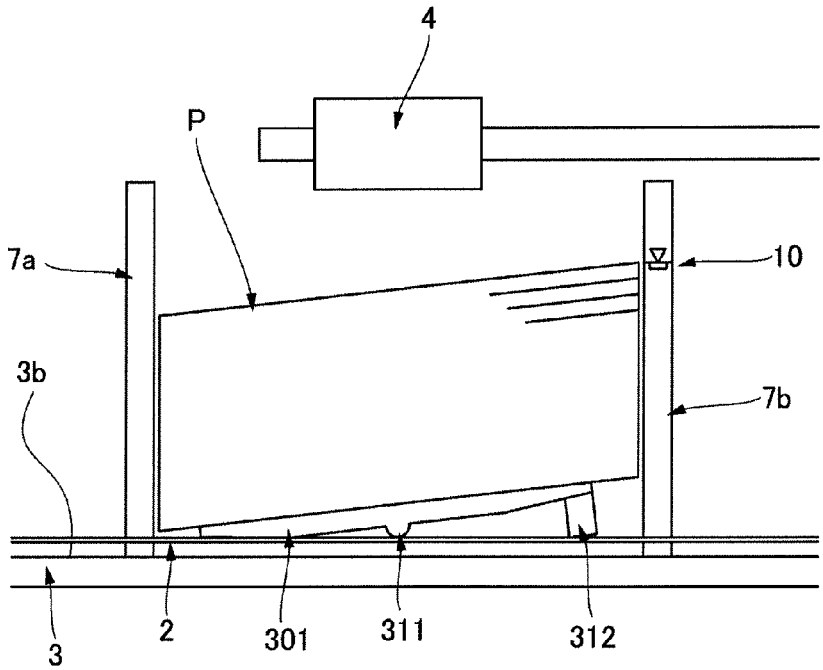
FIGS. 7A and 7B are diagrams describing the sheet stacking state of the sheet feeding apparatus.
Figure 7B:
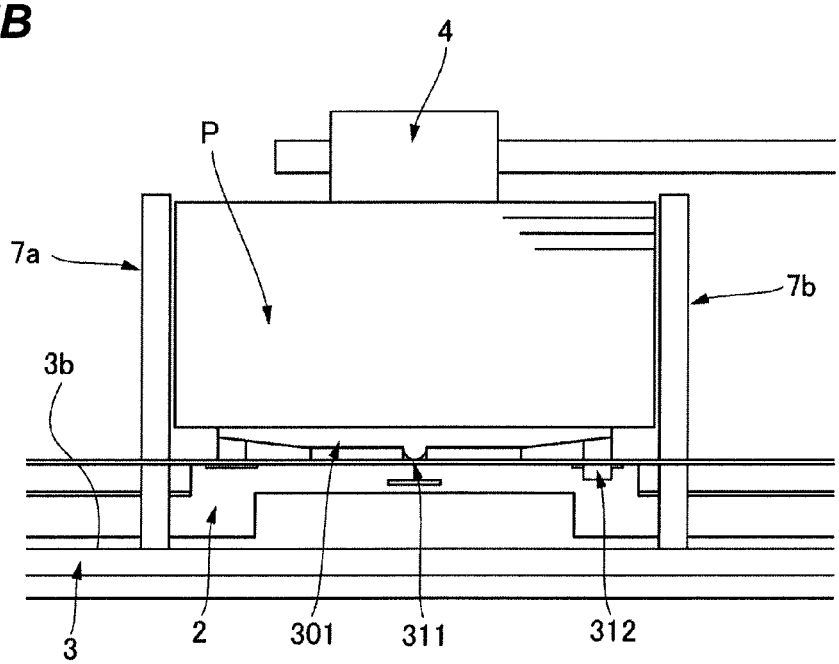

When the bundle of sheets P is set, as illustrated in FIG. 7A, the rear side of the upper surface of the bundle of sheets P is set according to the sheet stack upper limit displaying portion 10. At this time, the swing regulating portion 312 of the auxiliary tray 301 is abutted onto the bottom 3*b* of the cassette body 3*a*, so that the auxiliary tray 301 is not tilted to the rear side. Therefore, when the rear side of the upper surface of the bundle of sheets P is set according to the sheet stack upper limit displaying portion 10, the bundle of sheets P cannot exceed the sheet stack upper limit display to prevent excessive stacking. Thereafter, when the tray 2 is turned upward, the upper surface of the bundle of sheets P is abutted onto the pickup roller 4, so that as illustrated in FIG. 7B, the upper surface of the bundle of sheets P follows the pickup roller 4.

Figure 4B:
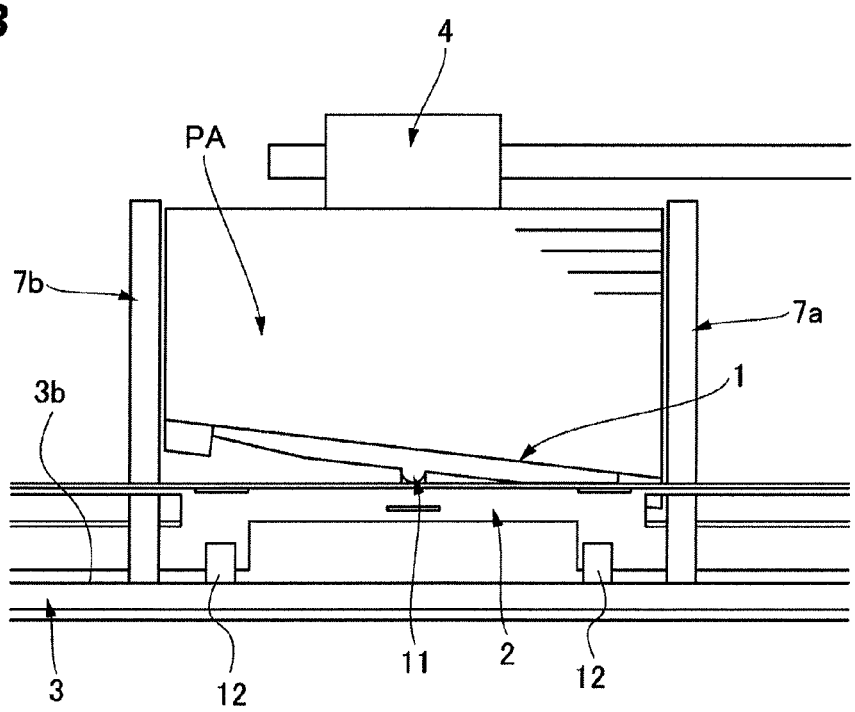

In the above description, the swing regulating portion is provided on the auxiliary tray. The present invention is not limited to this, and as illustrated in FIG. 4B, the swing regulating portions 12 may be projected to the auxiliary tray side from positions corresponding to both ends in the width direction of the auxiliary tray 1 on the bottom 3*b* of the cassette body 3*a*. That is, the swing regulating portions may be provided on any one of the auxiliary tray and the bottom 3*b* of the cassette body 3*a*.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-160255, filed Jul. 19, 2012, which is hereby incorporated by reference herein in its entirety.

What is claimed is:

1. A sheet feeding apparatus comprising:

a sheet accommodating portion which has a sheet accommodating portion body which accommodates sheets therein and a sheet stacking portion which is provided in the sheet accommodating portion body to be lifted and lowered and on which the sheets are stacked;

a sheet feeding portion which is provided above the sheet accommodating portion and feeds the sheets stacked on the sheet stacking portion;

a lifting and lowering portion which lifts the sheet stacking portion to press the sheets stacked on the sheet stacking portion onto the sheet feeding portion and lowered the sheet stacking portion to a lowered portion at which the sheets are set;

a swingable stacking portion which is swingably provided on the upper surface of the sheet stacking portion and on which the sheets are stacked, and the swingable stacking portion is swung by contacting the sheets stacked on the swingable stacking portion with the sheet feeding portion while lifting of the sheet stacking portion; and a swing regulating portion which regulates the swing of the swingable stacking portion when the sheet stacking portion is at the lowered position and releases the regulation of the swing of the swingable stacking portion when the sheet stacking portion is lifted from the lowered position.

2. The sheet feeding apparatus according to claim 1, wherein the swing regulating portion is provided on any one of the swingable stacking portion and a bottom of the sheet accommodating portion body.

3. The sheet feeding apparatus according to claim 1, wherein the swingable stacking portion is swingably provided on the upper surface of the sheet stacking portion so that both side ends in a width direction perpendicular to a sheet feeding direction are swung up and down when the sheet stacking portion is lifted from the lowered position.

4. The sheet feeding apparatus according to claim 1, wherein the swingable stacking portion is swingably provided on the upper surface of the sheet stacking portion so that the upstream end and the downstream end in the sheet feeding direction are swung up and down when the sheet stacking portion is lifted from the lowered position.

5. The sheet feeding apparatus according to claim 1, wherein the swing regulating portion is provided on at least one of both ends in the width direction of the swingable stacking portion.

6. The sheet feeding apparatus according to claim 3, wherein the swing regulating portion is provided in at least one of positions corresponding to both ends in the width direction of the swingable stacking portion on the bottom of the sheet accommodating portion body.

7. The sheet feeding apparatus according to claim 3, further comprising a sheet side end regulating portion which is provided in the sheet accommodating portion so as to regulate a position in the width direction of the sheets and has a sheet stack upper limit displaying portion which displays a sheet stack upper limit position on the inner wall surface thereof abutted onto the sheets.

8. The sheet feeding apparatus according to claim 1, wherein the swingable stacking portion is detachably provided on the sheet stacking portion.

9. An image forming apparatus comprising:

the sheet feeding apparatus according to claim 1; and an image forming portion which forms an image on a sheet fed by the sheet feeding apparatus.

10. A sheet feeding apparatus comprising:

a sheet accommodating portion which has a sheet accommodating portion body which accommodates sheets therein and a sheet stacking portion which is provided in the sheet accommodating portion body to be lifted and lowered and on which stacks the sheets are stacked thereon;

a sheet feeding portion which is provided above the sheet accommodating portion and feeds the sheets stacked on the sheet stacking portion;

a lifting and lowering portion which lifts the sheet stacking portion to press the sheets stacked on the sheet stacking portion onto the sheet feeding portion and lowered the sheet stacking portion to a lowered portion at which the sheets are set;

a swingable stacking portion which has on the lower surface thereof a projection abutted onto the upper surface of the sheet stacking portion to be swingably supported thereon and on which the sheets are stacked thereon; and a swing regulating portion which is provided on the swingable stacking portion, is abutted onto a bottom of the sheet accommodating portion body to regulate the swing of the swingable stacking portion when the sheet stacking portion is in the lowered position, and is separated from the bottom of the sheet accommodating portion body to release the regulation of the swing of the swingable stacking portion when the sheet stacking portion is lifted from the lowered position.

11. The sheet feeding apparatus according to claim 10, wherein the projection provided on the lower surface of the swinging member is extended in a sheet feeding direction at the center in a width direction perpendicular to the sheet feeding direction.

12. The sheet feeding apparatus according to claim 10, wherein the projection provided on the lower surface of the swinging member is formed to be semicircular.

13. The sheet feeding apparatus according to claim 11, wherein the swing regulating portion is provided on at least one of both ends in the width direction of the swingable stacking portion.

14. The sheet feeding apparatus according to claim 11, further comprising a sheet side end regulating portion which is provided in the sheet accommodating portion so as to regulate a position in the width direction of the sheets and has a sheet stack upper limit displaying portion which displays a sheet stack upper limit position on the inner wall surface thereof abutted onto the sheets.

15. An image forming apparatus comprising:

the sheet feeding apparatus according to claim 10; and an image forming portion which forms an image on a sheet fed by the sheet feeding apparatus.

* * * * *